US009605806B2

(12) United States Patent
Baym et al.

(10) Patent No.: US 9,605,806 B2
(45) Date of Patent: Mar. 28, 2017

(54) LIQUEFIED BREATHING GAS SYSTEMS FOR UNDERGROUND MINES

(75) Inventors: Michael H. Baym, Cambridge, MA (US); W. Daniel Hillis, Encino, CA (US); Roderick A. Hyde, Redmond, WA (US); Muriel Y. Ishikawa, Livermore, CA (US); Jordin T. Kare, Seattle, WA (US); Conor L. Myhrvold, Bellevue, CA (US); Nathan P. Myhrvold, Bellevue, WA (US); Tony Pan, Cambridge, MA (US); Clarence T. Tegreene, Bellevue, WA (US); Charles Whitmer, North Bend, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 330 days.

(21) Appl. No.: 13/553,403

(22) Filed: Jul. 19, 2012

(65) Prior Publication Data

US 2014/0020787 A1 Jan. 23, 2014

(51) Int. Cl.

| | |
|---|---|
| ***E21F 1/00*** | (2006.01) |
| ***F17D 1/00*** | (2006.01) |
| ***B65B 1/00*** | (2006.01) |

(52) U.S. Cl.

CPC ..... *F17D 1/00* (2013.01); *B65B 1/00* (2013.01); *E21F 1/00* (2013.01); *Y10T 137/0318* (2015.04)

(58) Field of Classification Search

CPC ..... A62B 7/06; A62B 7/00; A62B 7/02; E21F 17/00; E21F 3/00; E21F 11/00; F24F 5/0085

USPC ..... 454/168, 169, 171, 172; 128/201.21; 165/59, 61–66; 60/375, 675

See application file for complete search history.

(56) References Cited

U.S. PATENT DOCUMENTS

| | | | | |
|---|---|---|---|---|
| 1,005,196 | A * | 10/1911 | Gold | 454/172 |
| 2,069,269 | A | 2/1937 | Perkins | |
| 2,299,793 | A | 10/1942 | Cannaday et al. | |
| 3,318,307 | A * | 5/1967 | Nicastro | 128/201.21 |
| 5,488,828 | A * | 2/1996 | Brossard | 60/675 |
| 2005/0247308 | A1 | 11/2005 | Frye et al. | |
| 2008/0122286 | A1 | 5/2008 | Brock et al. | |
| 2008/0302505 | A1 * | 12/2008 | Kato et al. | 165/61 |

(Continued)

FOREIGN PATENT DOCUMENTS

| | | | |
|---|---|---|---|
| DE | EP 2216504 A2 * | 8/2010 | B61B 13/10 |
| GB | 1116494 GB | 6/1968 | |

OTHER PUBLICATIONS

PCT International Search Report; International App. No. PCT/US2013/049871; Dec. 16, 2013; pp. 1-2.

(Continued)

*Primary Examiner* — Steven B McAllister
*Assistant Examiner* — Ko-Wei Lin
(74) *Attorney, Agent, or Firm* — Foley & Lardner LLP

(57) ABSTRACT

A method of transporting liquefied breathing gases in underground mines includes providing a conduit system that extends within a mine shaft to a work space below ground where the conduit system includes an outlet positioned in the work space, delivering liquefied breathing gases through the conduit system, and vaporizing the liquefied breathing gases at the outlet of the conduit system.

31 Claims, 6 Drawing Sheets

(56) References Cited

U.S. PATENT DOCUMENTS

| | | | | |
|---|---|---|---|---|
| 2009/0076475 | A1 | 3/2009 | Ross et al. | |
| 2010/0105308 | A1* | 4/2010 | Masse | 454/168 |
| 2010/0263607 | A1* | 10/2010 | Travaly | F22G 5/16 122/476 |
| 2011/0041848 | A1 | 2/2011 | Stone et al. | |

OTHER PUBLICATIONS

American Liquid Air Company—New York 1900, printed on Nov. 19, 2012, retrieved from internet URL: scripophily.stores.yahoo.net/amliairconew.html, 5 pages.
CAREvent DRA—Automatic Handheld Mine Rescue Resuscitator, CSE Corporation, retrieved on Dec. 4, 2012, 2 pages.
Mine Rescue Team Equipment; Final Rule, Federal Register, Sep. 15, 2008, vol. 73, No. 179, pp. 53116-53124.
Mine Rescue, Office of Mine Safety and Licensing, printed on Nov. 19, 2012, retrieved from internet URL: omsl.ky.gov/Pages/MineRescue.aspx, 2 pages.
Mine ventilation and air conditioning, 3rd Edition, 1997 John Wiley & Sons, p. 657.
Mine Ventilation, The Engineering Index, printed on Nov. 19, 2012, retrieved from internet URL:books.google.com/books?id=U1A0AAAAMAAJ&pg=PA645&lpg=PA645&dq=mine ventilation, liquid air&source=bl&ots=ewuFi3Gf74&sig=8RA-9f5unDJu4n4t7KBUO4rgED8&h1=en&ei=ItDXTu35McOqsQKi3cTyDQ&sa=X&oi=book_result&ct=result&resnum=1&ved=0CCYQ6AEwAA#v=onepage&q=mine%20ventilation%2C%20liquid%20air&f=true, 1 page.
O'Neal and Johnson, "Metal Mine Ventilation Systems", Chapter 14, pp. 524-545.
Chinese State Intellectual Property Office, Notification of the First Office Action; App. No. 2013/80038505.0; Dec. 30, 2015 (received by our agent on Jan. 13, 2016); pp. 1-10; (machine translation provided).
European Patent Office, Supplementary European Search Report, Pursuant to Rule 62 EPC; App. No. EP 13820090; Jun. 22, 2016 (received by our Agent on Jul. 4, 2016); pp. 1-7.
The State Intellectual Property Office of P.R.C.; Notification of the Second Office Action; App. No. 2013/80038505.0; Jul. 13, 2016 (received by our agent on Jul. 18, 2016); pp. 1-3 (machine translation provided).

* cited by examiner

LIQUEFIED BREATHING GAS SYSTEMS FOR UNDERGROUND MINES

BACKGROUND OF THE INVENTION

Breathable air is typically supplied to an underground mine by a ventilation system configured to move gaseous breathable air into and within the underground mine and to remove exhaust gases from the underground mine. Typically, the ventilation system includes conduits (e.g. pipes, ducts, tubes, etc.) extending from above ground into the mine below ground. The conduits are of a relatively large diameter due to the amount of gaseous air that needs to be moved into, within, and out of the underground mine. Breathable air is moved into and within the mine by air moving equipment including fans, blowers, and air compressors. Air moving equipment is also used to remove the exhaust air from the underground mine. Air moving equipment is typically very noisy while in operation. Also, the ventilation system typically includes air conditioning systems within the underground mine to cool and condition air within the mine.

SUMMARY OF THE INVENTION

One exemplary embodiment relates to a method of transporting liquefied breathing gases in underground mines. The method includes providing a conduit system that extends within a mine shaft to a work space below ground where the conduit system includes an outlet positioned in the work space, delivering liquefied breathing gases through the conduit system, and vaporizing the liquefied breathing gases at the outlet of the conduit system.

Another exemplary embodiment relates to a liquefied breathing gas system for use in underground mines. The liquefied breathing gas system includes a conduit system that extends within a mine shaft to a work space below ground where the conduit system includes an outlet positioned in the work space, a source of liquefied breathing gases fluidly coupled to the conduit system, and a vaporizing device at the outlet where the vaporizing device is configured to vaporize the liquefied breathing gases.

Another exemplary embodiment relates to a method of transporting liquefied exhaust gases in underground mines. The method includes providing an exhaust conduit system that extends within a mine shaft from a work space below ground, liquefying exhaust gases from the work space, and delivering the liquefied exhaust gases through the exhaust conduit system.

Another exemplary embodiment relates to a liquefied exhaust gas system for use in underground mines. The liquefied exhaust system includes an exhaust conduit system that extends within a mine shaft from a work space below ground, a liquefying device configured to cool and pressurize exhaust gases from the work space to liquefy the exhaust gases, and an exhaust pump configured to pump the liquefied exhaust gases from the liquefying device through the conduit system.

Another exemplary embodiment relates to a method of providing breathing gases for a miner working in an underground mine. The method includes providing a miner with a portable source of liquefied breathing gases and vaporizing the liquefied breathing gases from the portable source as needed for breathing by the miner while in an underground mine.

BRIEF DESCRIPTION OF THE DRAWINGS

The invention will become more fully understood from the following detailed description, taken in conjunction with the accompanying drawings, wherein like reference numerals refer to like elements, in which.

Figure 1:
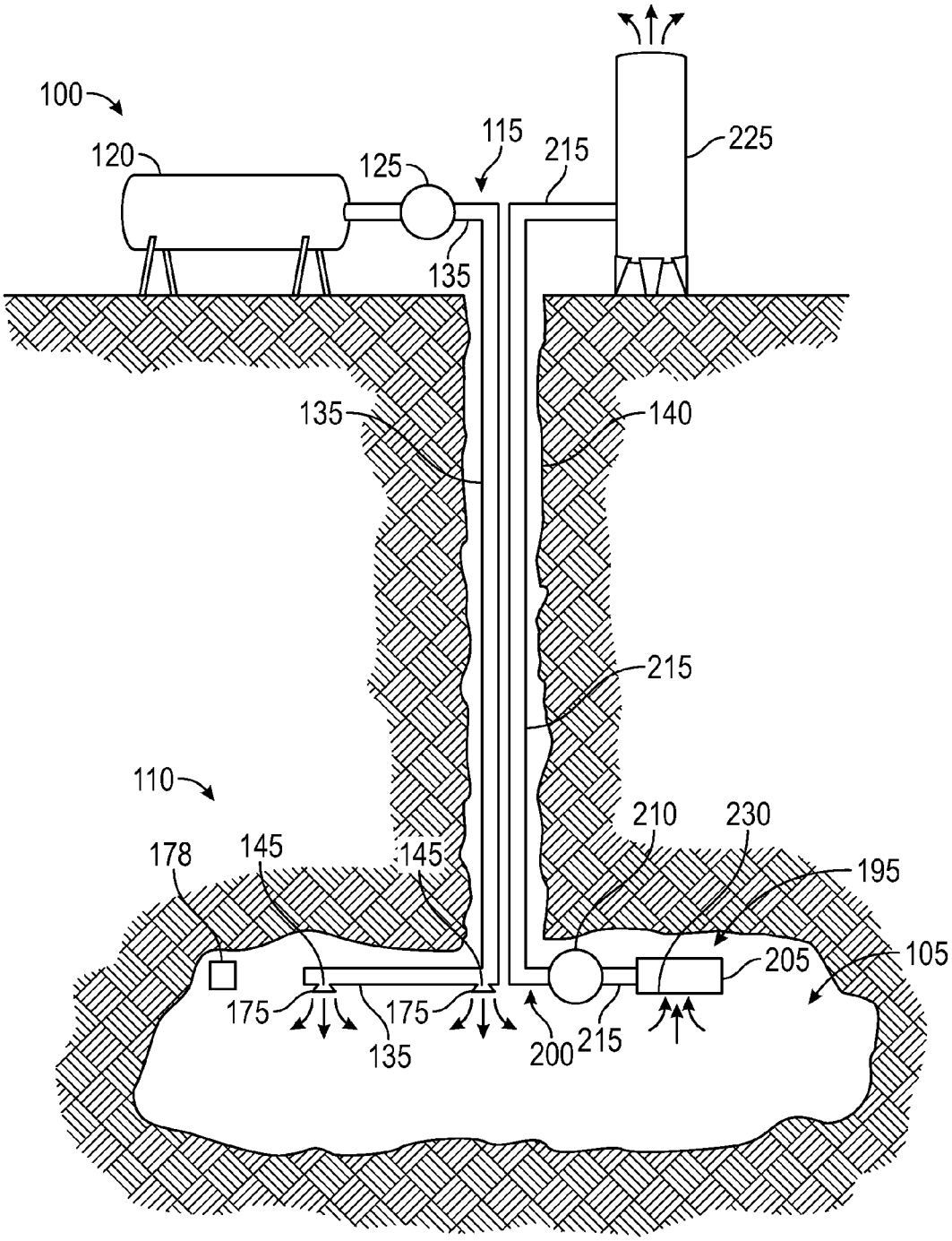
FIG. 1 is a schematic view of a liquefied breathing gas system and a liquefied exhaust gas system for use in an underground mine.

The skilled artisan will understand that the drawings primarily are for illustrative purposes and are not intended to limit the scope of the inventive subject matter described herein.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to FIGS. 1-4, a liquefied breathing gas system 100 is shown, according to an exemplary embodiment. Liquefied breathing gas system 100 is used to supply breathable gases to at least one work space 105 of an underground mine 110. Liquefied breathing gas system 100 includes a conduit system 115, a source 120 of liquefied breathing gases fluidly coupled to conduit system 115, and a pump 125 for delivering or pumping liquefied breathing gases from source 120 through conduit system 115. Alternatively, a gravity head established by the change in elevation of the conduit system 115 can be used for all or part of the delivering of liquefied breathing gases, a pressure accumulator (either with pressurized liquefied breathing gases or a pressurized gas contacting the liquefied breathing gases) can be used for delivering liquefied breathing gases, multiple pumps 125 at more than one location along the conduit system 115 can be used for delivering liquefied breathing gases, or a source of suction can be used so that suction is used for delivering liquefied breathing gases. Liquefied breathing gas system 100 can be used to replace a conventional gaseous breathing gas system 130 (shown in FIG. 3.)

Liquefied breathing gases are gases suitable for breathing that have been liquefied. For example, liquefied breathing gases can be liquefied oxygen or liquefied air. Liquefied air can include liquefied oxygen in concentrations greater than or less than twenty-one percent. By transporting liquefied air with oxygen at concentrations where combustion is impossible, the fire risk associated with liquefied air is reduced. Liquefied oxygen in the liquefied air can be diluted by nitrogen gas or a component gas other than nitrogen.

Figure 2:
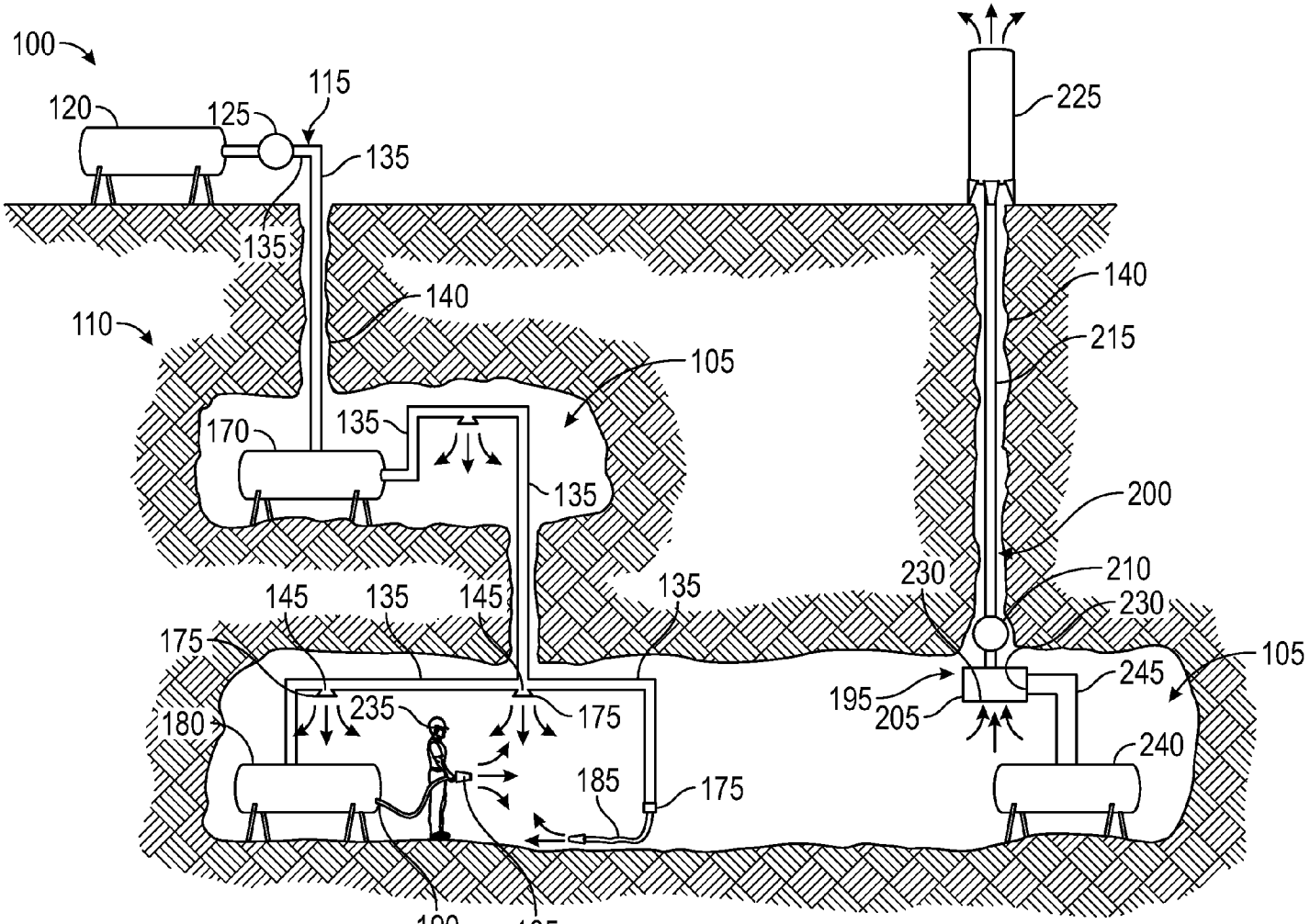
FIG. 2 is a schematic view of the liquefied breathing gas system and the liquefied exhaust gas system of FIG. 1.
Figure 3:
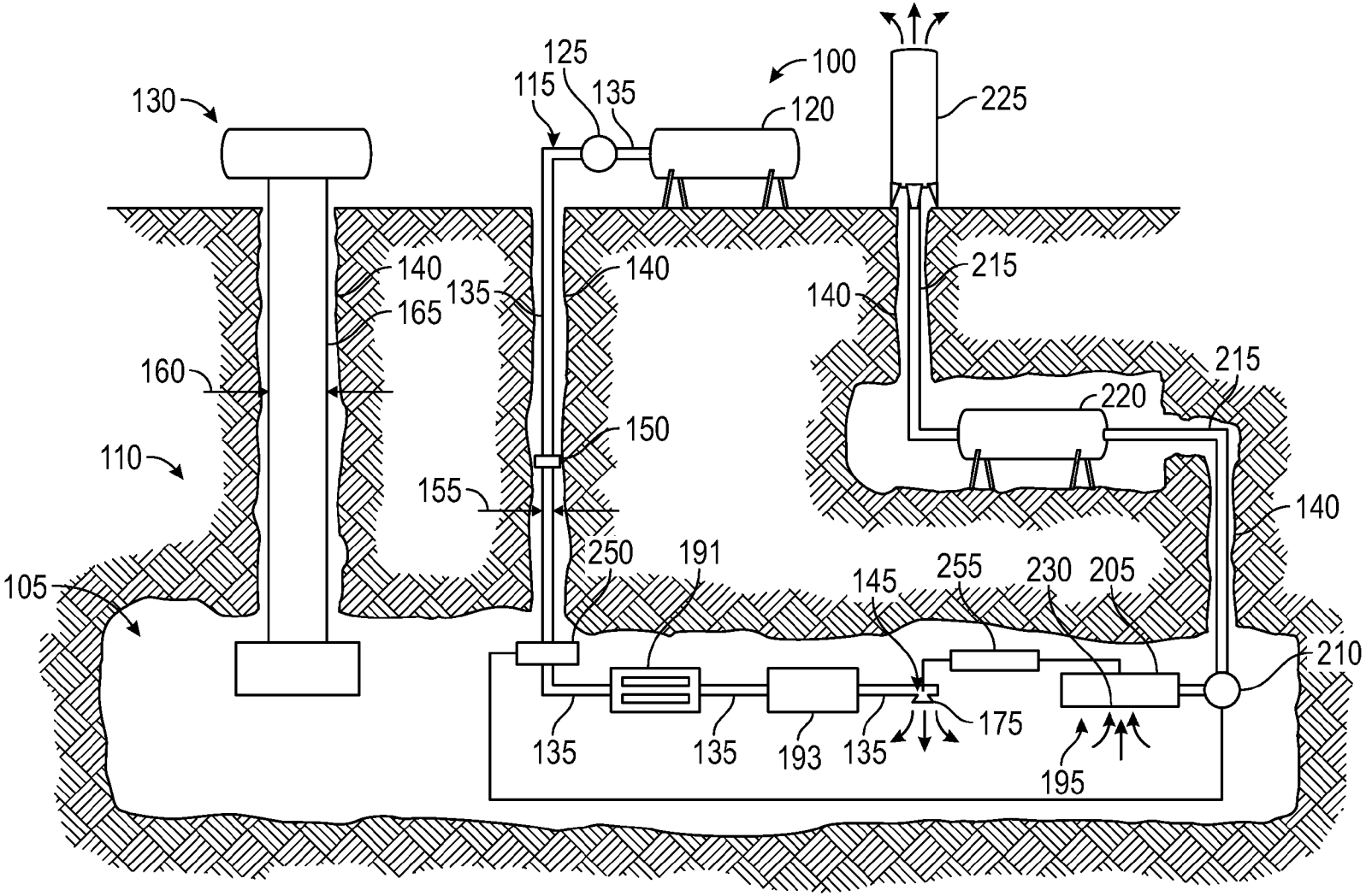
FIG. 3 is a schematic view of the liquefied breathing gas system and the liquefied exhaust gas system of FIG. 1.
Figure 4:
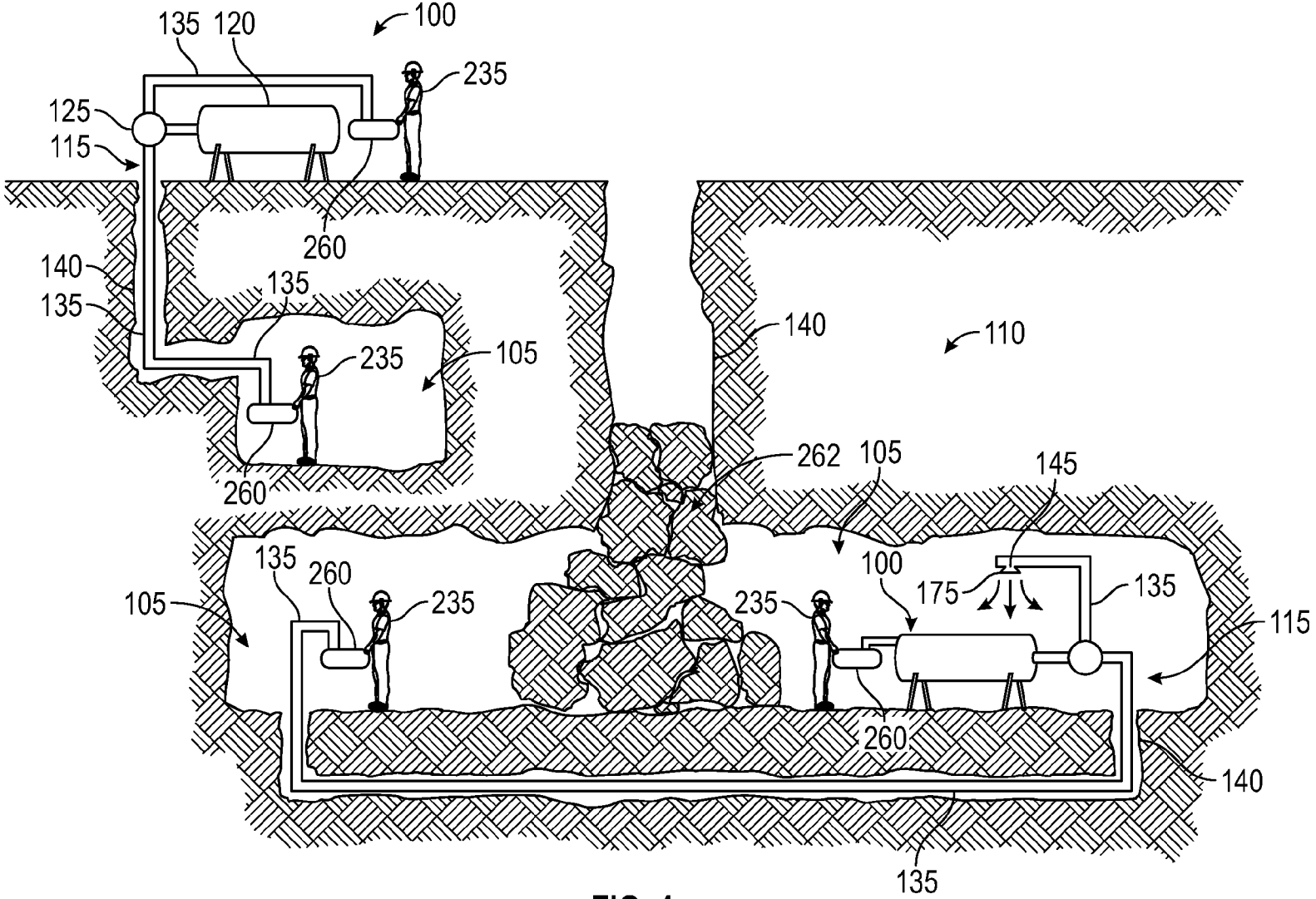
FIG. 4 is a schematic view of two liquefied breathing gas systems of FIG. 1.

As shown in FIGS. 1-4, conduit system 115 includes at least one conduit 135 (e.g. pipe, duct, tube, etc.), but frequently includes multiple conduits 135 fluidly connected to one another. Conduits 135 extend through mine shafts 140. Conduit system 115 can extend from above ground to a location below ground (FIGS. 1-3) or conduit system 115 can extend between two locations below ground (FIG. 4). Conduit system 115 also includes at least one outlet 145 positioned in a work space 105 located below ground. Frequently, conduit system 115 includes more than one outlet 145. Preferably, conduits 135 are armored to protect conduits 135 from hazards posed by the mining environment. Conduits 135 are insulated so that the liquefied breathing gases delivered through the conduit system 115 do not unintentionally vaporize between source 120 and outlet 145. Preferably, multi-layer insulation is used to insulate conduits 135, although other insulations such as aerogel, closed or open cell foams, beads or powders can also be effective. Preferably, conduits 135 are not pressurized. Liquefied breathing gases do not need to be pressurized to remain stable as a liquid, so long as they are kept below their boiling points. As shown in FIG. 3, pressure management devices 150 (e.g., pressure regulators, reducers, and relief valves) can be included in the conduit system 115 to control pressure within the conduits 135 and/or to let off pressure in an overpressure situation. In particular, pressure management devices 150 may be necessary to handle the gravity-induced pressure head from the surface.

As shown in FIG. 3, conduits 135 of conduit system 115 have an outer diameter 155 smaller than the outer diameter 160 of conduits 165 used in a conventional gaseous breathing gas system 130. The smaller size of conduits 135 for carrying liquefied breathing gases is one advantage of liquefied breathing gas system 100 over conventional gaseous breathing gas system 130. Smaller conduits 135 take up less space in mine shafts 140, which allows for smaller shafts or more room in a shaft for other equipment. In an exemplary embodiment, the cross-sectional area of the conduit 135 is less than 10% of the cross-sectional area of the mine shaft 140. In another exemplary embodiment, the cross-sectional area of the conduit 135 is less than 1% of the cross-sectional area of the mine shaft 140. Also, in other embodiments, liquefied breathing gas system 100 may make drilling a separate shaft dedicated to ventilation of gases from the underground mine 110 to a location above ground unnecessary. Other existing shafts may be used for this ventilation purpose. Alternatively, liquefied breathing gas system 100 allows for a smaller diameter shaft to be used for ventilation of gases from the underground mine 110 to the surface. Reducing the number of shafts and/or the size of the shafts reduces the costs associated with ventilating the underground mine 100.

Source 120 of liquefied breathing gases is fluidly connected to conduit system 115. Source 120 is a vessel suitable for storing liquefied breathing gases (e.g., a storage tank, reservoir, bladder, or pressure vessel). One vessel or more than one interconnected vessels (single type or multiple types) can be source 120. Alternatively, source 120 can be a liquefying device that is configured to liquefy breathing gases and provide liquefied breathing gases to conduit system 115. Liquefying device can be combined with one or more vessels (single type or multiple types) as source 120. Source can be positioned above ground (FIGS. 1-4) or below ground (FIG. 4). As shown in FIG. 2, a buffer or storage tank 170 is fluidly coupled between conduits 135 to temporarily store a supply of liquefied breathing gases, for example, to provide a source of liquefied breathing gases in an emergency situation. This storage tank 170 can also be considered to be a source 120 of liquefied breathing gases. Connecting storage tank 170 to conduit system 115 keeps storage tank 170 topped-off with liquefied breathing gases so that in an emergency situation where the supply of liquefied breathing gases from source 120 is cut off, storage tank 170 can be used as an emergency supply of liquefied breathing gases.

As shown in FIGS. 1-4, a pump 125 is fluidly coupled to each source 120 and its related conduit system 115 to pump liquefied breathing gases from source 120 through conduit system 115. Pump 125 is required to produce much less pumping power to move liquefied breathing gases through conduit system 115 than conventional gaseous breathing gas system 130 requires to move the gaseous air. This is in part due to the downward gravity head established by the downward force exerted by gravity on the liquefied breathing gases. Pump 125 also creates less noise than the pumps, fans, or other devices used to move gaseous breathing gas through conventional gaseous breathing gas system 130. Alternatively, pump 125 includes more than one pumping unit.

After liquefied breathing gases reach outlet 145 of the conduit system 115, liquefied breathing gases can be put to different uses in underground mine 110. As shown in FIG. 1, a vaporizing device 175 is at each of two outlets 145 positioned in work space 105. Vaporizing device or vaporizer 175 vaporizes liquefied breathing gases into gaseous breathing gases which are exhausted into work space 105. Gaseous breathing gases can be directly exhausted from vaporizing device 175 to work space 105 or can be exhausted to human breathing equipment, (e.g., a ventilation system that distributes gaseous breathing gases throughout work space 105, a mouthpiece, a portal source of breathing gases, etc.). Vaporizing device 175 heats liquefied breathing gases to vaporize liquefied breathing gases. Ambient heat near outlet 145 can be used to vaporize liquefied breathing gases. Alternatively, vaporizing device 175 includes a heating element, heat exchanger, or other heating device configured to heat liquefied breathing gases. The liquefied breathing gases can be used not just for human respiration, but also to provide oxygen to combustion machinery such as generators, mining equipment, downhole vehicles, etc. The vaporization rate of the liquefied breathing gases at a vaporizing device 175 and/or the delivery rate of the liquefied breathing gases to a vaporizing device 175 can be controlled by a sensor 178 (FIG. 1) or in response to a schedule. Sensor 178 is configured to detect conditions in which more or less gaseous breathing gases are required. For example, the sensor 178 can be configured to detect the pressure, temperature, or composition of the ambient air in the work space 105, the number of miners in the work space 105, the power requirements of a combustion machine, etc. The schedule alters the vaporization rate and/or the delivery rate in response to scheduled changes in the working condition of the work space 105. The schedule can be implemented on a controller. For example, the schedule can reflect shift changes for miners, times when the work space 105 is not occupied by humans, times when larger or smaller work crews of miners are present in the work space 105, times when combustion machinery will be operated in the work space 105, etc.

As shown in FIG. 2, liquefied breathing gases can be used as a source of compressed air. Liquefied breathing gases can be used directly from conduit system 115 or temporarily stored in a reservoir 180 fluidly coupled to conduit system 115. A device requiring compressed air 185 (e.g., a pressurized air hose, an air-powered tool, an air-powered vehicle) is coupled to a vaporizing device 175 configured to produce compressed air or to a compressed air outlet 190 of reservoir 180. For example, the compressed air can be used to sweep out dust or explosive residue from blasting in work space 105. Alternatively, the liquefied breathing gases can be used to provide compressed compositions other than air.

As shown in FIG. 3, conduit system 115 is fluidly coupled to an air conditioner 191 so that cold liquefied breathing gases are thermally coupled to air conditioner 191 for use as the coolant of air conditioner 191. Air conditioner 191 thermally couples cold liquefied breathing gases with warmer air in work space 105 to cool air in the work space 105. In some embodiments, air conditioner 191 includes a heat exchanger and a fan.

As shown in FIG. 3, conduit system 115 is fluidly coupled to a dehumidifier 193 so that cold liquefied breathing gases are thermally coupled to dehumidifier 193 for use as the coolant of dehumidifier 193. Dehumidifier 193 allows condensation to form by thermally coupling cold liquefied breathing gases to warmer, humid air in work space 105 to dehumidify air in work space 105. In some embodiments, dehumidifier 193 includes a heat exchanger, a fan, and a condensation collector. Air conditioner 191 and dehumidifier 193 can be combined as a single unit.

Referring to FIGS. 1-3, a liquefied exhaust gas system 195 is also shown. Liquefied exhaust system 195 can be considered to be a stand-alone system or a component of liquefied breathing gas system 100. Liquefied exhaust gas system 195 is used to removed exhaust gases from at least one work space 105 of underground mine 110. Liquefied exhaust gas system 195 includes an exhaust conduit system 200, a liquefying device 205 fluidly coupled to conduit system 200, and an exhaust pump 210 for delivering or pumping liquefied exhaust gases through exhaust conduit system 200. The pump may act directly on the liquefied exhaust gases via positive pressure; alternatively it may act as a suction pump, or it may act to pressurize a gas which then applies pumping pressure to the liquefied exhaust gases. Liquefied exhaust gas system 195 is similar to liquefied breathing gas system 100, except that liquefied exhaust gas system 195 removes gases in liquid form from underground mine 110 rather than providing gases in liquid form to underground mine 110.

As shown in FIGS. 1-3, exhaust conduit system 200 includes at least one conduit 215, but frequently includes multiple conduits 215 fluidly connected to one another. As shown in FIG. 1, at least one conduit 215 extends through the same mine shaft 140 as a conduit 135 of conduit system 115. As shown in FIG. 2, at least one conduit 215 of exhaust conduit system 200 extends through a different mine shaft 140 than conduit system 115. Preferably, conduits 215 are similar in construction and function to conduits 135 (e.g., armored, insulated, and not pressurized).

Exhaust conduit system 200 can extend from below ground to above ground (FIGS. 1, 2, and 4) or exhaust conduit system 200 can extend between two locations below ground (FIG. 3). As shown in FIG. 3, a storage tank 220 is fluidly coupled to store liquefied exhaust gases at a location below ground. Stored liquefied exhaust gases can eventually be transported above ground or put to other uses in underground mine 110. Once above ground, liquefied exhaust gases can be vaporized and then exhausted to atmosphere via an exhaust stack 225 or put to other uses in liquid or gaseous form.

Liquefying device or liquefier 205 is configured to cool gaseous exhaust gases from work space 105 to liquefy exhaust gases. Liquefying device 205 includes at least one inlet 230 for receiving gaseous exhaust gases from work space 105. Referring to FIG. 2, exhaust gases can include gases exhaled by a miner or person 235 in work space 105 and can include gases exhausted by a combustion machine 240 (e.g., a generator, or a vehicle engine) in work space 105. Combustion machine 240 can exhaust directly into work space 105 or can be connected by an exhaust duct 245 to an inlet 230 of liquefying device 205.

Exhaust gases in work space 105 include multiple component gases. Liquefying device 205 can liquefy all of the component gases making up the exhaust gases or can liquefy one or more individual component gases of the exhaust gases. For example, liquefying device 205 can be configured to liquefy one or more of carbon monoxide, carbon dioxide, or nitrogen oxides ($NO_x$). Different component gases liquefy at different temperatures.

As shown in FIGS. 1-3, exhaust pump 210 is fluidly coupled to conduit system 200 and liquefying device 205 to deliver or pump liquefied exhaust gases from liquefying device 205 through conduit system 200. The liquefying rate of the exhaust gases at the liquefying device 205 and/or the delivery rate of the liquefied exhaust gases from the liquefying device 205 can be controlled by a sensor 178 (FIG. 1) or in response to a schedule in manners similar to those explained above with respect to the vaporization rate and delivery rate of the liquefied breathing gases.

As shown in FIG. 3, an energy recovery device 250 fluidly coupled to or among conduit system 115 is used to recover some of the energy from the downward gravity head of the liquefied breathing gases. Energy recovery device 250 converts downward gravity head into electrical power (via a generator) or mechanical power. This electrical power or mechanical power can be stored for later use or put to use elsewhere in underground mine 110. For example, as shown in FIG. 3, energy recovery device 250 is coupled to exhaust pump 210 of liquefied exhaust gas system 195 to provide a gravity head to pump liquefied exhaust gases through exhaust conduit system 200. In some embodiments, the energy recovery device is a generator or an accumulator.

As shown in FIG. 3, a heat exchanger 255 is thermally coupled to vaporizing device 175 of liquefied breathing gas system 100 and thermally coupled to liquefying device 205 of liquefied exhaust gas system 195. Heat exchanger 255 transfers the waste heat given off by condensation of exhaust gases in liquefying device 205 to vaporizing device 175 to provide heat for vaporizing liquefied breathing gases.

Referring to FIG. 4, liquefied breathing gas system 100 can be used to supply liquefied breathing gas to portable sources 260 of liquefied breathing gases for personal use by a miner 235 working in underground mine 110. Miner 235 is able to carry the portable source 260 with him into and around underground mine 110. Portable source 260 includes a vaporizing device that vaporizing liquefied breathing gas stored in portable source 260 as needed for breathing by miner 235. In a preferred embodiment, portable source 260 includes a storage vessel and a backpack. Liquefied breathing gas system 100 can provide liquefied breathing gas via an outlet 145 near source 120 of liquefied breathing gas or at a location remote from source 120. Liquefied breathing gas can be provided to portable source 260 at a location above ground or at a location below ground. For example, miner 235 could fill his portable source 260 from an above ground outlet 145 of liquefied breathing gas system 100 at the start of a work shift so that he has a personal supply of breathing gases that will last through the work shift or through a portion of the work shift. Underground outlets 145 could be used to top off portable source 260 during the work shift or be available to fill portable source 260 during emergency situations such as the cave-in 262 shown in FIG. 4. In another example, miner 235 is provided with the portable source 260 after an event occurs that causes an emergency situation. Portable storage of liquefied breathing gases can also be utilized for mine vehicles (i.e., to provide breathing gases to occupants, or to provide combustion gases for their engines).

Liquefied breathing gas system can be used during normal mining operations or during emergency situations. An emergency liquefied breathing gas system can be installed prior to the emergency situation. For example, an emergency liquefied breathing gas system with an above ground source of liquefied breathing gas is installed prior to an emergency situation and is only activated during emergency situations. The liquefied breathing gases can be delivered during the emergency by active means such as pumps, or by passive means such as gravity head or a pre-pressurized accumulator. As another example, an emergency liquefied breathing gas system with a below ground source of liquefied breathing gas is installed prior to an emergency situation and is only activated during emergency situations. Either of these emergency breathing gas systems can be configured to vaporize liquefied breathable gases at a work space, to fill a portable source of liquefied breathing gases, or to do both. An emergency liquefied breathing gas system can also be installed after an event occurs that causes the emergency situation. For example, a cave-in or collapse of a mine shaft traps miners in a work space. A new mine shaft is drilled to the work space and an emergency liquefied breathing gas system then installed to provide liquefied breathable gases to the miners trapped in the work space. The emergency breathing gas system can be configured to vaporize liquefied breathable gases at the work space, to fill a portable source of liquefied breathing gases, or to do both. It is easier and faster to drill a new mine shaft suitable for an emergency liquefied breathing gas system than for a conventional gaseous breathing gas system because of the smaller diameter conduits used in a liquefied breathing gas system.

Figure 5:
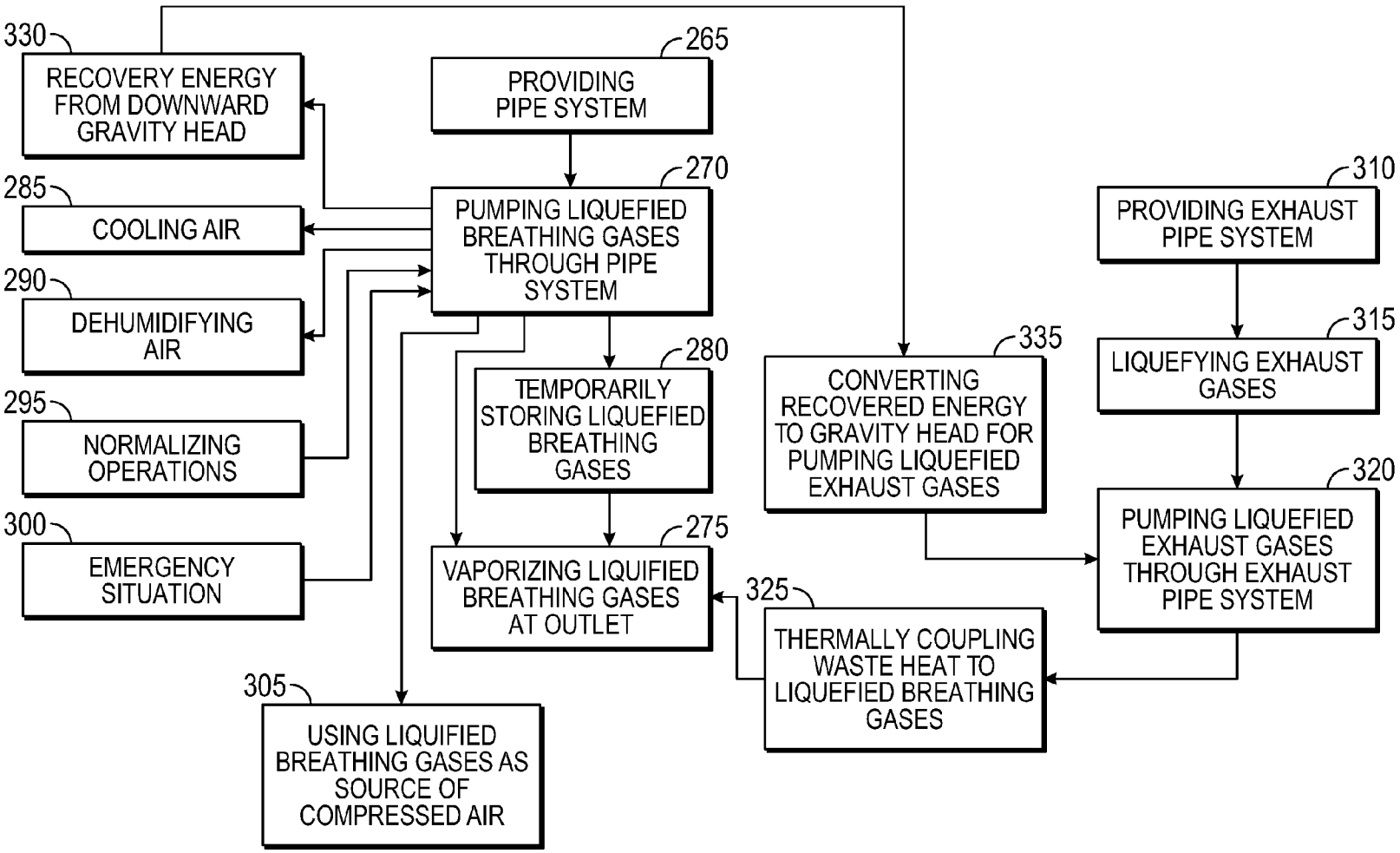
FIG. 5 is a flowchart of a method of transporting liquefied breathing gases and of a method of transporting liquefied exhaust gases.

Referring to FIG. 5, a method of transporting liquefied breathing gases in an underground mine with a liquefied breathing gas system is illustrated, according to one exemplary embodiment. First, a conduit system is provided so that conduit system extends within a mine shaft to a work space below ground (step 265). Next, liquefied breathing gases are delivered through conduit system (e.g., by a pump) (step 270). Then, liquefied breathing gases are vaporized at an outlet of the conduit system (step 275). Alternatively, liquefied breathing gases are temporarily stored in a storage tank prior to being vaporized at the outlet (step 280). Optionally, air in the work space is cooled by thermally coupling liquefied breathing gases to the air to be cooled via an air conditioner 191. Optionally, air in the work space is dehumidified by allowing condensation to form by thermally coupling the liquefied breathing gases to air in the work space via a dehumidifier (step 290). Delivering liquefied breathing gases through the conduit system can occur during normal mining operations (step 295) and/or during emergency situations (step 300). Additionally, liquefied breathing gases can be used as a source of compressed air (step 305).

Still referring to FIG. 5, a method of transporting liquefied exhaust gases in an underground mine with a liquefied exhaust gas system is illustrated, according to one exemplary embodiment. First, an exhaust conduit system is provided so that the exhaust conduit system extends from a work space (step 310). Next, exhaust gases from the work space are liquefied by a liquefying device (step 315). Then, liquefied exhaust gases are delivered through the exhaust conduit system (e.g., by a pump) (step 320). This method as described above can stand on its own or can be incorporated into the method of transporting liquefied breathing gases also illustrated in FIG. 5. Optionally, via a heat exchanger 255, waste heat from liquefying the exhaust gases is thermally coupled to liquefied breathing gases to vaporize liquefied breathing gases at the outlet of the conduit system (step 325). Optionally, an energy recovery device recovers energy from the downward gravity head of liquefied breathing gases (step 330). Then, the recovered energy is used to provide a gravity head for delivering liquefied exhaust gases through the exhaust conduit system (step 335).

Figure 6:
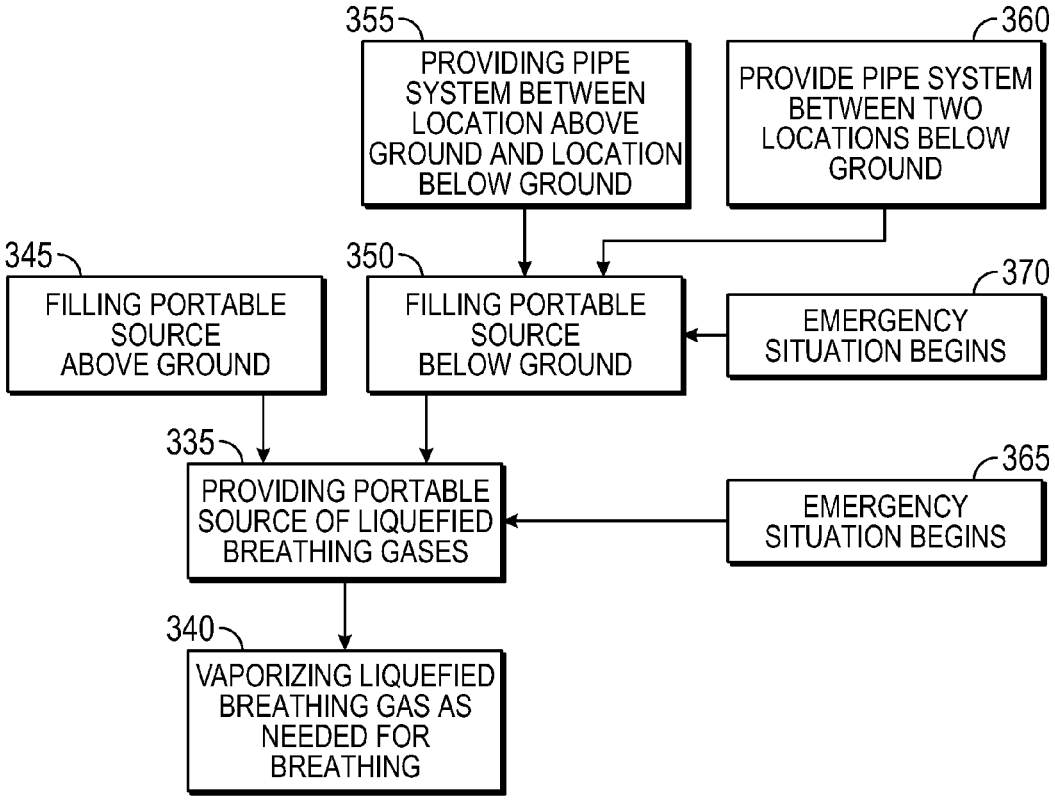
FIG. 6 is a flowchart of a method of providing breathing gases for a miner.

Referring to FIG. 6, in a method according to one exemplary embodiment, a miner is provided with breathing gases for use working in an underground mine. First, the miner is provided with a portable source of liquefied breathing gases (step 335). Then, liquefied breathing gases are vaporized from the portable source as needed for breathing by the miner while in the underground mine (step 340). The portable source can be filled with liquefied breathing gases at a location above ground (step 345) or at a location below ground (step 350). When the portable source is filled at a location below ground, a conduit system for conveying liquefied breathing gases to the portable source can be provided from a location above ground to the filling location below ground (step 355) or a conduit system can be provided from a first location below ground to a second location below ground (step 360). When using the portable source in emergency situations, the miner can be provided with the portable source after an emergency situation begins (step 365). The portable source can be filled with liquefied breathing gases at a location below ground before or after the emergency situation begins (step 370).

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A method of transporting liquefied breathing gases in underground mines, comprising:

providing a source of liquefied breathing gases at a fixed location above ground;

providing a conduit system that extends within a mine shaft to a work space below ground, wherein the conduit system includes an outlet positioned in the work space and the conduit system extends from the source of liquefied breathing gases to the outlet;

delivering liquefied breathing gases through the conduit system;

vaporizing the liquefied breathing gases at the outlet of the conduit system;

providing an exhaust conduit system that extends from the work space;

liquefying exhaust gases from the work space;

delivering the liquefied exhaust gases through the exhaust conduit system to a location above ground downstream of the work space and remote from the work space;

vaporizing the liquefied exhaust gases at the location above ground; and exhausting the vaporized exhaust gases to atmosphere from the location above ground.

2. The method of claim 1, wherein delivering liquefied breathing gases through the conduit system includes delivering liquefied oxygen through the conduit system.

3. The method of claim 1, wherein delivering liquefied breathing gases through the conduit system includes delivering liquefied air through the conduit system.

4. The method of claim 3, wherein delivering liquefied air through the conduit system includes delivering liquefied air with an oxygen concentration higher than twenty-one percent through the conduit system.

5. The method of claim 3, wherein delivering liquefied air through the conduit system includes delivering liquefied air with an oxygen concentration lower than twenty-one percent through the conduit system.

6. The method of claim 3, wherein delivering liquefied air through the conduit system includes delivering liquefied air having oxygen diluted by nitrogen through the conduit system.

7. The method of claim 3, wherein delivering liquefied air through the conduit system includes delivering liquefied air having oxygen diluted by a component gas other than nitrogen through the conduit system.

8. The method of claim 1, wherein liquefying exhaust gases from the work space includes liquefying the exhaust gases at a liquefying rate controlled by a sensor.

9. The method of claim 1, wherein liquefying exhaust gases from the work space includes liquefying the exhaust gases at a liquefying rate controlled by a schedule.

10. The method of claim 1, wherein delivering the liquefied exhaust gases through the exhaust conduit system includes delivering the liquefied exhaust gases at a delivery rate controlled by a sensor.

11. The method of claim 1, wherein delivering the liquefied exhaust gases through the exhaust conduit system includes delivering the liquefied exhaust gases at a delivery rate controlled by a schedule.

12. The method of claim 1, wherein providing an exhaust conduit system includes providing an exhaust conduit system that extends through the mine shaft.

13. The method of claim 1, wherein providing an exhaust conduit system includes providing an exhaust conduit system that extends through a second mine shaft.

14. The method of claim 1, wherein liquefying exhaust gases includes liquefying the entirety of the exhaust gases.

15. The method of claim 1, wherein liquefying exhaust gases includes liquefying a portion of the exhaust gases.

16. The method of claim 15, wherein liquefying a portion of the exhaust gases includes liquefying at least one of carbon monoxide, carbon dioxide, and nitrogen oxides.

17. The method of claim 1, wherein providing an exhaust conduit system that extends from the work space includes providing an exhaust conduit system that extends from above ground to the work space below ground.

18. The method of claim 1, wherein providing an exhaust conduit system that extends from the work space includes providing an exhaust conduit system that extends from a first location below ground to a second location in the work space below ground.

19. The method of claim 1, further comprising:

providing an energy recovery device fluidly coupled to or among the conduit system; and using the energy recovery device to recover energy from a downward gravity head of the liquefied breathing gases.

20. The method of claim 19, further comprising:

using the recovered energy to provide a gravity head for delivering liquefied exhaust gases through the exhaust conduit system.

21. The method of claim 1, further comprising:

thermally coupling waste heat from liquefying the exhaust gases to the liquefied breathing gases for vaporizing the liquefied breathing gases at the outlet of the conduit system.

22. The method of claim 1, wherein liquefying the exhaust gases includes liquefying exhaust gases exhaled by a person in the work space.

23. The method of claim 1, wherein liquefying the exhaust gases includes liquefying exhaust gases exhausted by a combustion machine in the work space.

24. The method of claim 1, further comprising:

providing the vaporized breathing gases to a piece of human breathing equipment.

25. A method of transporting liquefied exhaust gases in underground mines, comprising:

providing an exhaust conduit system that extends within a mine shaft from a work space below ground;

liquefying exhaust gases from the work space;

delivering the liquefied exhaust gases through the exhaust conduit system to a location above ground downstream of the work space and remote from the work space;

vaporizing the liquefied exhaust gases at the location above ground; and exhausting the vaporized exhaust gases to atmosphere from the location above ground.

26. The method of claim 25, wherein liquefying exhaust gases includes liquefying the entirety of the exhaust gases.

27. The method of claim 25, wherein liquefying exhaust gases includes liquefying a portion of the exhaust gases.

28. The method of claim 27, wherein liquefying a portion of the exhaust gases includes liquefying at least one of carbon monoxide, carbon dioxide, and nitrogen oxides.

29. The method of claim 25, further comprising:

thermally coupling waste heat from liquefying exhaust gases from the work space to a heat exchanger.

30. The method of claim 25, wherein liquefying exhaust gases includes liquefying exhaust gases exhaled by a person in the work space.

31. The method of claim 25, wherein liquefying exhaust gases includes liquefying exhaust gases exhausted by a combustion machine in the work space.

* * * * *